US010974854B2

(12) United States Patent
Toro

(10) Patent No.: US 10,974,854 B2
(45) Date of Patent: Apr. 13, 2021

(54) PACKAGING MACHINE

(71) Applicant: SYSTEM S.P.A., FIORANO MODENESE (IT)

(72) Inventor: Andrea Toro, Fiorano Modenese (IT)

(73) Assignee: SYSTEM CERAMICS S.P.A., Fiorano Modenese (IT)

( * ) Notice: Subject to any disclaimer, the term of this patent is extended or adjusted under 35 U.S.C. 154(b) by 154 days.

(21) Appl. No.: 16/075,250

(22) PCT Filed: Feb. 24, 2017

(86) PCT No.: PCT/IB2017/051077
§ 371 (c)(1),
(2) Date: Aug. 3, 2018

(87) PCT Pub. No.: WO2017/149422
PCT Pub. Date: Sep. 8, 2017

(65) Prior Publication Data

US 2019/0039762 A1 Feb. 7, 2019

(30) Foreign Application Priority Data

Mar. 2, 2016 (IT) ..... 102016000021752

(51) Int. Cl.
*B65B 23/20* (2006.01)
*B65B 11/54* (2006.01)
(Continued)

(52) U.S. Cl.
CPC ..... *B65B 23/20* (2013.01); *B65B 11/48* (2013.01); *B65B 11/54* (2013.01); *B65B 41/06* (2013.01);
(Continued)

(58) Field of Classification Search
CPC ..... B65B 23/20; B65B 49/08; B65B 43/44; B65B 11/004; B65B 11/54; B65B 11/48; B65B 11/58; B65B 11/585; B31B 2105/00; B31B 2105/001; B31B 2105/0024; B31B 2105/0025; B31B 2105/0027
(Continued)

(56) References Cited

U.S. PATENT DOCUMENTS 1,862,205 A 6/1932 Stokes
3,585,776 A * 6/1971 Euwe ..... B65B 11/004 53/447
(Continued)

FOREIGN PATENT DOCUMENTS

EP 0994028 A1 4/2000
WO 2015173744 11/2015

*Primary Examiner* — Valentin Neacsu
(74) *Attorney, Agent, or Firm* — Pearne & Gordon LLP

(57) ABSTRACT

An improved packaging machine, comprising: a rest surface (2) for supporting one or more blanks (B) intended to form a quadrangular packaging (C); containing means (3), structured for containing a plurality of blanks (B) destined to form the packaging; handier means (4), structured so as to pick up the blanks (B) from the containing means (3) and to arrange them on the rest surface (2), folder means (5), structured so as to fold the blanks (B) in such a way as to form the packaging; a store (31,32,33,34) for each side of the packaging (C); a handier (41,42,43,44) for each side of the packaging (C).

9 Claims, 15 Drawing Sheets

(51) Int. Cl.

| | |
|---|---|
| ***B65B 11/48*** | (2006.01) |
| ***B65B 41/06*** | (2006.01) |
| ***B65B 43/44*** | (2006.01) |
| ***B65B 49/08*** | (2006.01) |
| ***B65D 85/46*** | (2006.01) |
| ***B65B 51/02*** | (2006.01) |
| ***B65B 59/00*** | (2006.01) |

(52) U.S. Cl.
CPC ..... *B65B 43/44* (2013.01); *B65B 49/08* (2013.01); *B65B 51/02* (2013.01); *B65B 59/001* (2019.05); *B65D 85/46* (2013.01); *B65B 51/023* (2013.01)

(58) Field of Classification Search
USPC ..... 53/209, 173, 158, 154, 156, 155, 443; 493/113, 389, 379, 386, 393, 76
See application file for complete search history.

(56) References Cited

U.S. PATENT DOCUMENTS

| | | | | |
|---|---|---|---|---|
| 5,564,254 | A | 10/1996 | Thimon et al. | |
| 7,954,304 | B2 * | 6/2011 | Toro | B65D 5/32 53/429 |
| 8,202,207 | B2 * | 6/2012 | Toro | B65G 47/766 493/56 |
| 2007/0277480 | A1 * | 12/2007 | Ford | B65B 11/105 53/443 |
| 2010/0243505 | A1 * | 9/2010 | Toro | B65H 3/10 206/521 |
| 2011/0214402 | A1 | 9/2011 | Toro | |
| 2011/0281705 | A1 * | 11/2011 | Aganovic | B65D 5/6644 493/89 |
| 2017/0057190 | A1 | 3/2017 | Toro | |

* cited by examiner

PACKAGING MACHINE

The present invention relates to an improved packaging machine. The packaging machine of the invention is particularly useful for packaging flat products stacked on one another. For example, the packaging machine is particularly effective for packaging ceramic tiles.

The packaging method at present most widely used for ceramic tiles includes forming packs comprising some tiles stacked on one another. A stack of tiles is contained by a packaging, typically made of blanked cardboard, which envelops only the lateral edges and a peripheral upper and lower border of the stack thereof.

The package comprises four sides, each of which comprises a lateral portion, which defines a lateral flank of the package, an upper portion, which defines an upper surface of the package, and a lower portion, which defines a lower surface of the package. The upper portion and the lower portion are substantially parallel to one another, while the lateral portion is perpendicular to the upper portion and the lower portion. The four sides are arranged in a rectangle.

Each side of the package, seen in section along a perpendicular plane to the longitudinal extension thereof, substantially has a C-shaped profile with an opening facing toward the other sides and the central zone of package. In a known way, this conformation enables the packaging to contain a stack of tiles along the perimeter thereof, covering the lateral surfaces of the tiles and a peripheral border of the topmost tile and a peripheral border of the bottom tile of the stack.

Each side of the packaging is constituted by a blank which is provided with a median flap, destined to define the lateral portion of the side. The blank further comprises at least a first lateral flap, joined to the median flap at a first fold line. The first lateral flap is destined to define the upper portion of the side. The blank further comprises at least a second lateral flap, joined to the median flap at a second fold line parallel to the first fold line. The second lateral flap is destined to form the lower portion of the side. Each blank is structured so as to be folded at the fold lines in order to assume a C-shaped conformation with an opening facing towards the other sides of the packaging.

The packaging machines at present available are provided with one or two stores for temporary containing of the blanks necessary for realising the packaging. Handler means pick up the blanks from the stores and arrange them in the positions for making up the packaging. The handlers must perform considerably articulated and complex displacements and the stack of tiles must often be rotated about a vertical axis for facilitating the positioning of the blanks. All of the foregoing involves a significant complexity of the machine and a lengthening of production times.

The aim of the present invention is to provide an improved packaging machine which enables the drawbacks of the currently available machines to be obviated.

An advantage of the machine according to the present invention is to significantly simplify the displacements required of the handlers of the blanks, thus enabling a simplification of the structure of the handlers.

A further advantage of the machine according to the present invention is that it enables a significant reduction of the packaging times.

A further important advantage of the machine according to the present invention is that it can be rapidly adapted to packages of different dimensions.

Further characteristics and advantages of the present invention will become more apparent in the following detailed description of an embodiment of the present invention, illustrated by way of non-limiting example in the attached figures, in which.

Figure 3:
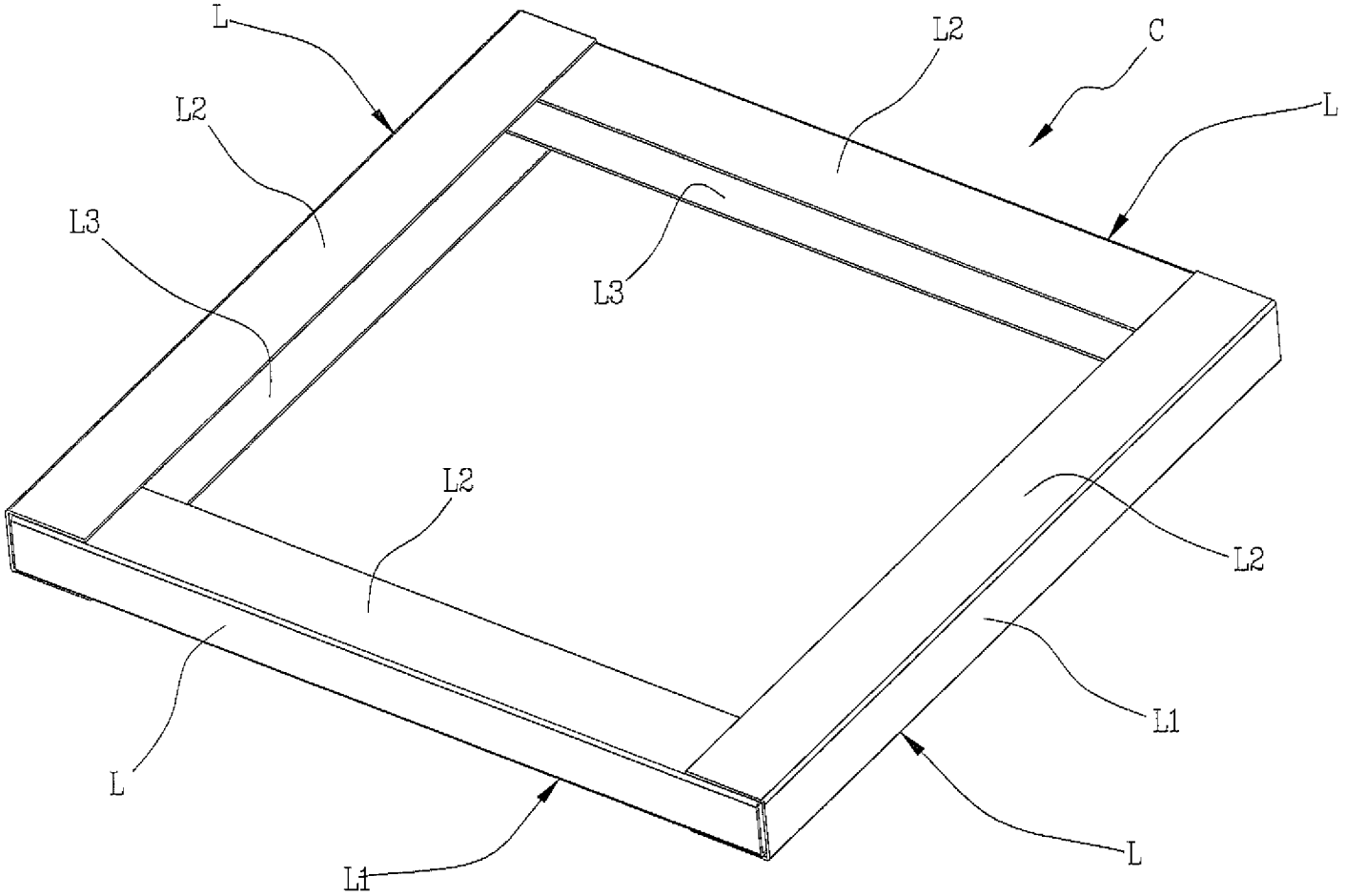
FIG. 3 shows a packaging (C) obtained using the blanks of FIG. 2.

The package (C), shown in FIG. 3, comprises four sides (L), each of which comprises a lateral portion (L1), which defines a lateral flank of the package, an upper portion (L2), which defines an upper surface of the package, and a lower portion (L3), which defines a bottom surface of the package. The upper portion and the lower portion are substantially parallel to one another, while the lateral portion is perpendicular to the upper portion and the lower portion. The four sides are arranged in a rectangle.

Each side of the package, seen in section along a perpendicular plane to the longitudinal extension thereof, substantially has a C-shaped profile with an opening facing toward the other sides and the central zone of package. In a known way, this conformation enables the packaging to contain a stack of tiles along the perimeter thereof, covering the lateral surfaces of the tiles and a peripheral border of the topmost tile and a peripheral border of the bottom tile of the stack.

Figure 1:
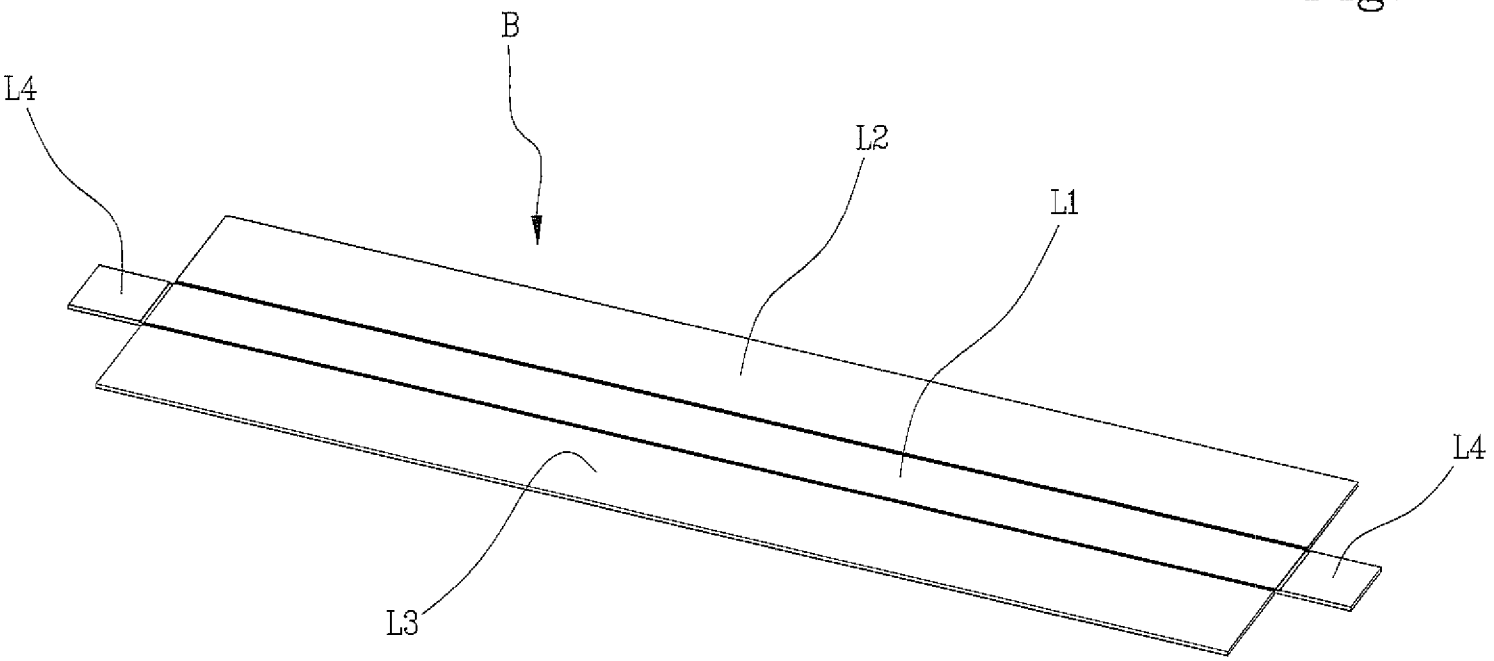
FIG. 1 illustrates a blank (B) usable in the machine according to the present invention.

Each side of the package comprises a blank (B), illustrated in FIG. 1, which is provided with a median flap (L1), destined to define the lateral portion of the side. The blank further comprises a first lateral flap (L2), joined to the median flap (L1) at a first fold line. The first lateral flap is destined to define the upper portion (L2) of the side. The blank further comprises a second lateral flap (L3), joined to the median flap (L1) at a second fold line that is parallel to the first fold line. The second lateral flap is destined to form the lower portion (L3) of the side. Each blank (B) is structured so as to be folded at the fold lines thereof so as to assume a C-shaped conformation with an opening facing towards the other sides of the package.

The packaging machine according to the present invention comprises a rest surface (2) for supporting one or more blanks (B) destined to form a quadrangular packaging (C); The rest surface (2) can be defined for example by one or more pairs of motorised belts, associated to a main frame of the machine and mobile along a transport direction (Y). The motorised belts can advantageously be mobile in a perpendicular direction to the transport direction (Y), in order to adapt to articles (A) of variable length. The machine further comprises a support (20) for the articles to be packaged (A), for example a stack of ceramic tiles. The support (20) is vertically mobile between an upper position, in which it maintains the articles (A) above the rest surface (2), and a lower position, in which it deposits the articles (A) on the rest surface (2). In a possible embodiment, visible in particular in FIG. 8, the support (20) comprises a pair of elements that are mobile vertically, in reciprocal nearing and distancing motion. In a neared position, the mobile elements can support an article (A) to be packaged, while in a more distanced position the mobile elements can release the article (A). In a possible functioning cycle of the machine (which will be more fully described in the following) the blanks (C) necessary for making up the packaging (C) are priorly deposited on the rest surface (2) in a flat configuration (visible in FIG. 2 and in FIG. 9), while the products (A) are raised from the rest surface (2). Thereafter the articles (A) are deposited on the rest surface (2) to partly superpose on the blanks (B).

A transport line, not illustrated as known to the technical expert, can be used to convey the articles (A) to be packaged to the support (20) and/or to the rest surface (2).

The machine further comprises containing means, structured for containing a plurality of blanks (B) destined to form the packaging. The containing means comprise stores (31,32,33,34), each of which, in a possible embodiment, comprises two lateral borders (S1, S2) structured so as to laterally contain a stack of blanks (B) and a support abutment (S3) for supporting the stack of blanks (B).

Handler means (41,42,43,44) are structured so as to pick up the blanks (B) from the containing means and to arrange the blanks (B) on the rest surface (2).

In a possible embodiment, each handler (41,42,43,44) comprises a pick-up device (M1), structured for associating to a blank (B). In substance, the pick-up device (M1) is configured so as to be constrainable to a blank (B), so as to support it and displace it in space. In the illustrated embodiment the pick-up device (M1) comprises a plurality of suckers associated to a support bar.

A motor device (M2) (illustrated only schematically in the figures), is structured for moving the pick-up device (M1) between a pick-up position, in which the pick-up device (M1) can be associated with a blank (B) and a release position, in which the pick-up device (M1) can deposit the blank (B) on the rest surface (2). In the illustrated embodiment the motor device (M2) is operative on the support bar of the suckers.

Figure 6:
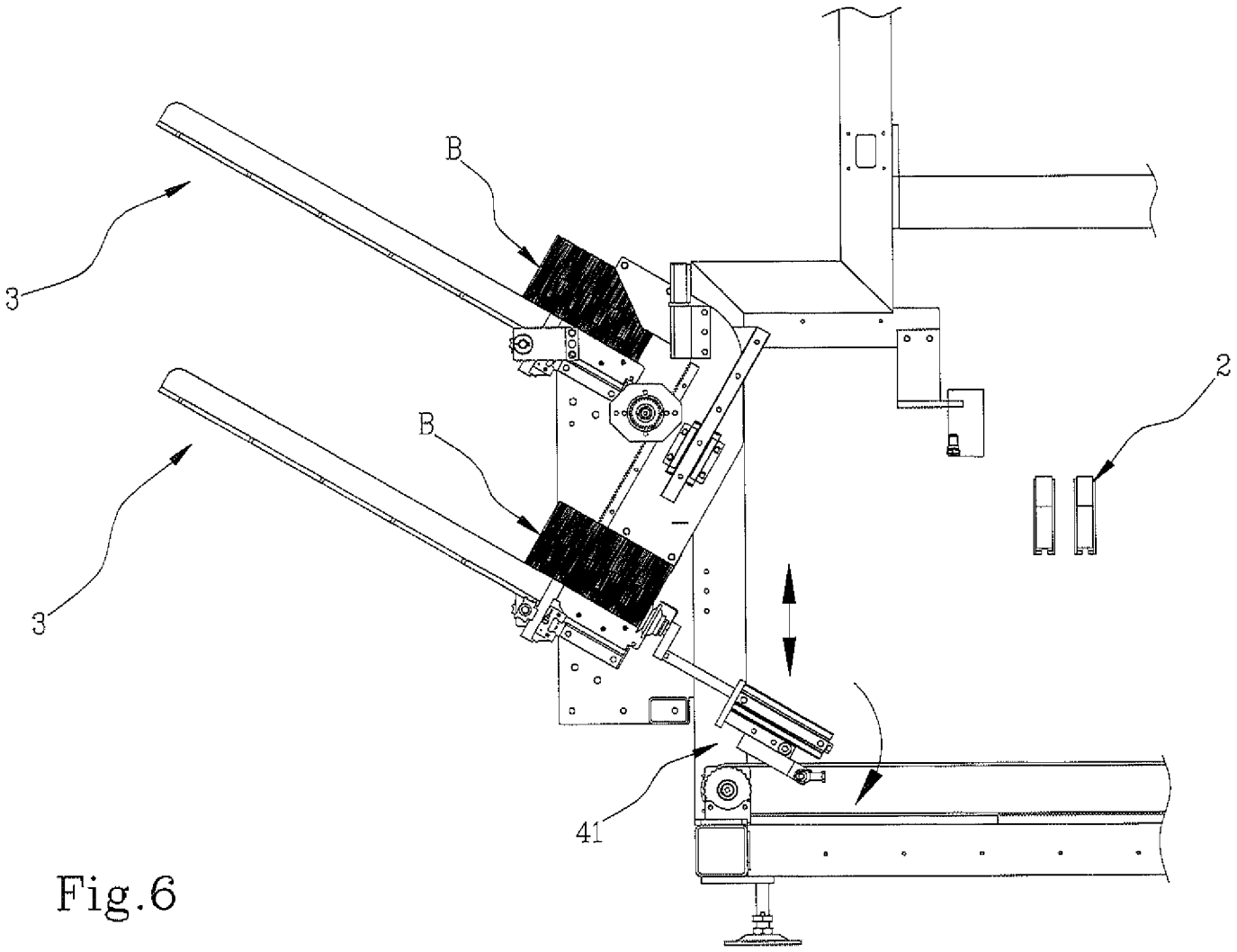
Figure 7:
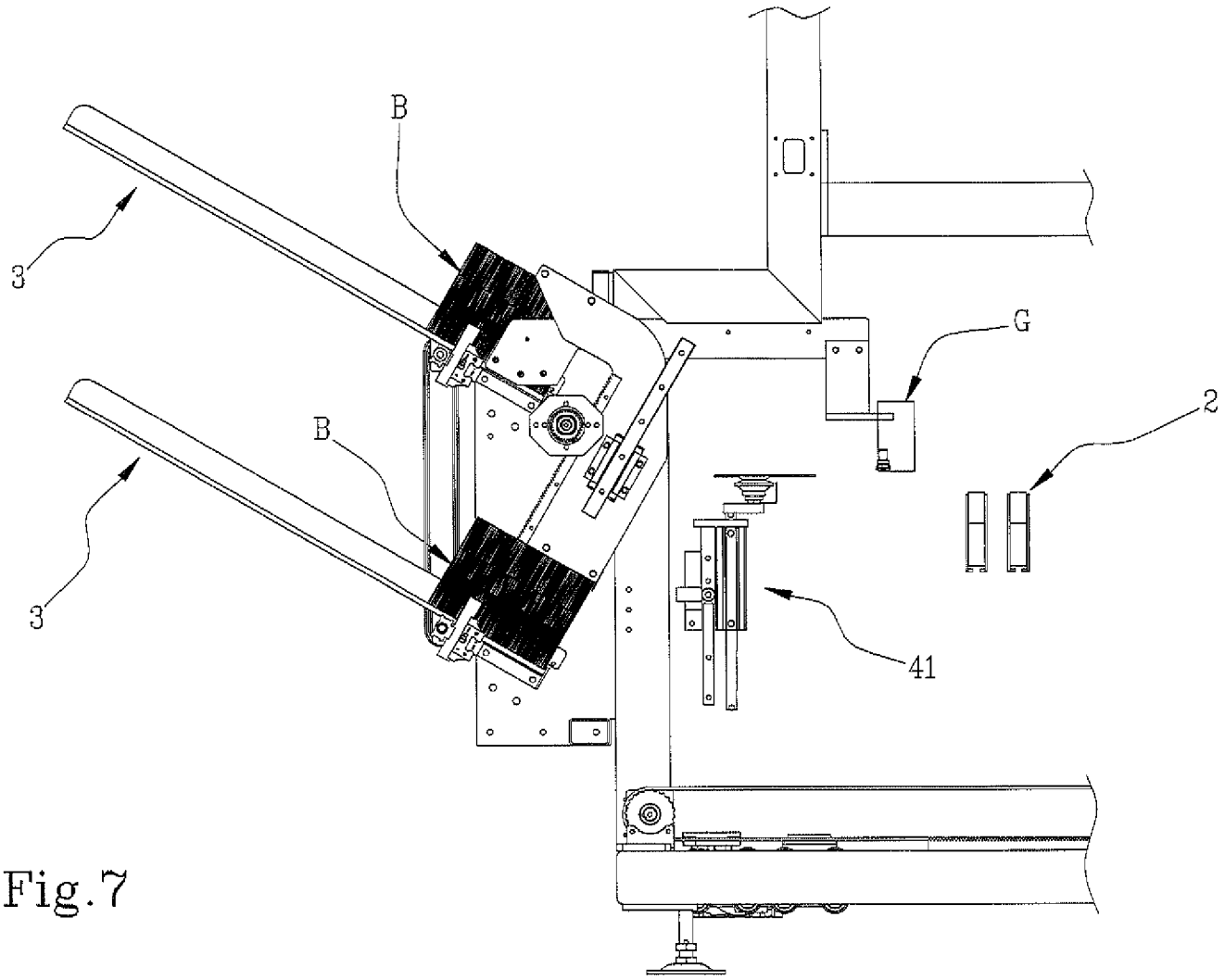

In the pick-up position (FIG. 6), the pick-up device (M1) is flanked to a store (31,32,33,34), in particular to the support abutment (S3) of the store, in a position such as to be able to reach the blank (B) arranged on the support abutment (S3). From the pick-up position, the pick-up device (M1), by means of the motor device (M2), displaces into the release position (FIG. 7). By performing this displacement the pick-up device (M1) removes the blank (B) from the relative store and deposits it on the rest surface (2).

In a possible embodiment, the motor device (M2) is structured for rotating the pick-up device (M1) about a first horizontal axis between the pick-up and the release positions. In combination with, or alternatively to, the rotation, the motor device (M2) can be structured so as to translate the pick-up device (M1) along a second horizontal axis that is perpendicular to the first, and/or along a further vertical axis perpendicular to the first. Various embodiments of the pick-up device (M1) and for the motor device (M2) are obviously possible, all within the knowledge of the expert in the sector.

The machine of the present invention advantageously comprises a store (31,32,33,34) for each side of the packaging (C), i.e. for each side of the article (A) to be packaged, and a handler (41,42,43,44) for each side of the packaging (C), i.e. for each side of the article (A) to be packaged. This enables significantly reducing the cycle times of the machine. In fact, owing to the arrangement of a store (31,32,33,34) in proximity of each side of the article (A) to be packaged, each handler only has to perform movements of very modest entity, considerably smaller than in the machines at present available. Further, the use of a handler for each side of the article (A) to be packaged enables significantly simplifying the structure of each handler, which is only required to be able to perform simple displacements of modest entity.

In the illustrated embodiment, the machine comprises four stores (31,32,33,34) all arranged along a rectangular perimeter. Each store is arranged in proximity of a side of the article (A) to be packaged, i.e. in proximity of a side of the space which is occupied by the article (A) to be packaged, which in the illustrated case is a pile or stack of tiles.

Each store (31,32,33,34), the configuration of which has been described in the foregoing, is therefore structured so as to contain at least a blank (B) in a flat configuration and parallel position to a side of the package (C), i.e. parallel to a side of the article (A) to be packaged. In other terms, considering a plan projection of the article (A) to be packaged, which has a rectangular perimeter or a quadrangular perimeter, each store is structured for containing at least a blank (B) parallel to a side of the plan projection of the article (A). The blank (B) is the one arranged resting on the abutment (S3) of the store, i.e. the one destined to be picked up by the corresponding handler. All the blanks (B) are preferably maintained in the above-described position, i.e. are arranged in a stack on the blank (B) resting on the abutment (S3) of the store.

In the illustrated embodiment, the stores (31,32,33,34) are overall orientated downwards nearingly to the rest surface (2). This enables maintaining the blanks (B) with a face turned downwards. In particular, the blank (B) resting on the abutment (S3) has a face turned downwards and facing towards the handler destined for the pick-up.

Each store (31,32,33,34) can advantageously be subdivided into two superposed parts, as shown in the figures, so as to be able to contain two distinct groups of blanks (B). This enables, for example, making available, for each side of the packaging, two different blanks in terms of dimensions and/or colour, or other characteristics.

The operating cycle of the handlers (41,42,43,44) can take place according to the following procedures.

Figure 2:
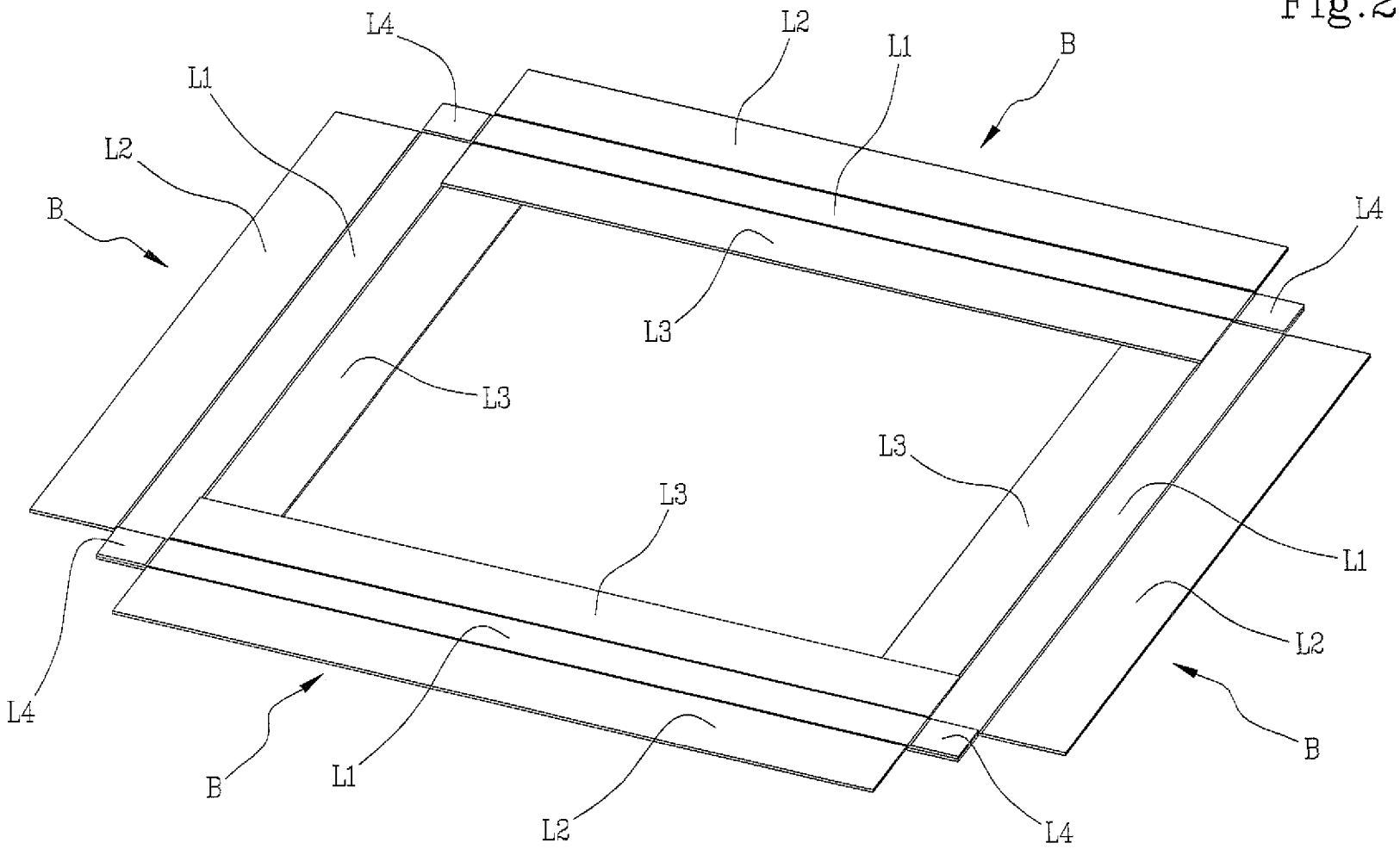
FIG. 2 shows four blanks (B) arranged in an intermediate configuration of the composition of the packaging (C)
Figure 8:
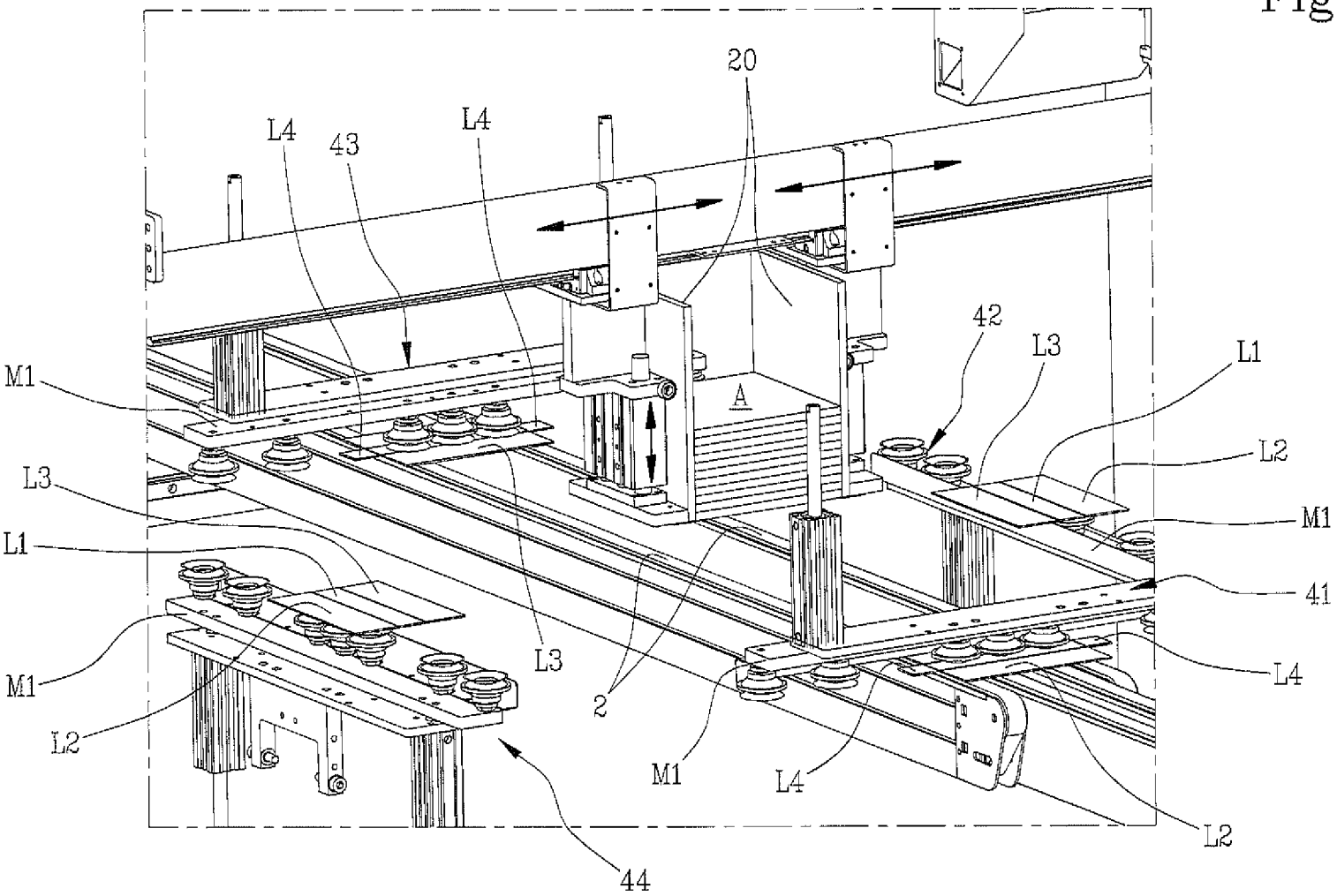
FIGS. 8, 9, 10 show three successive steps of the positioning of the blanks (B) and the articles (A) to be packaged.
Figure 9:
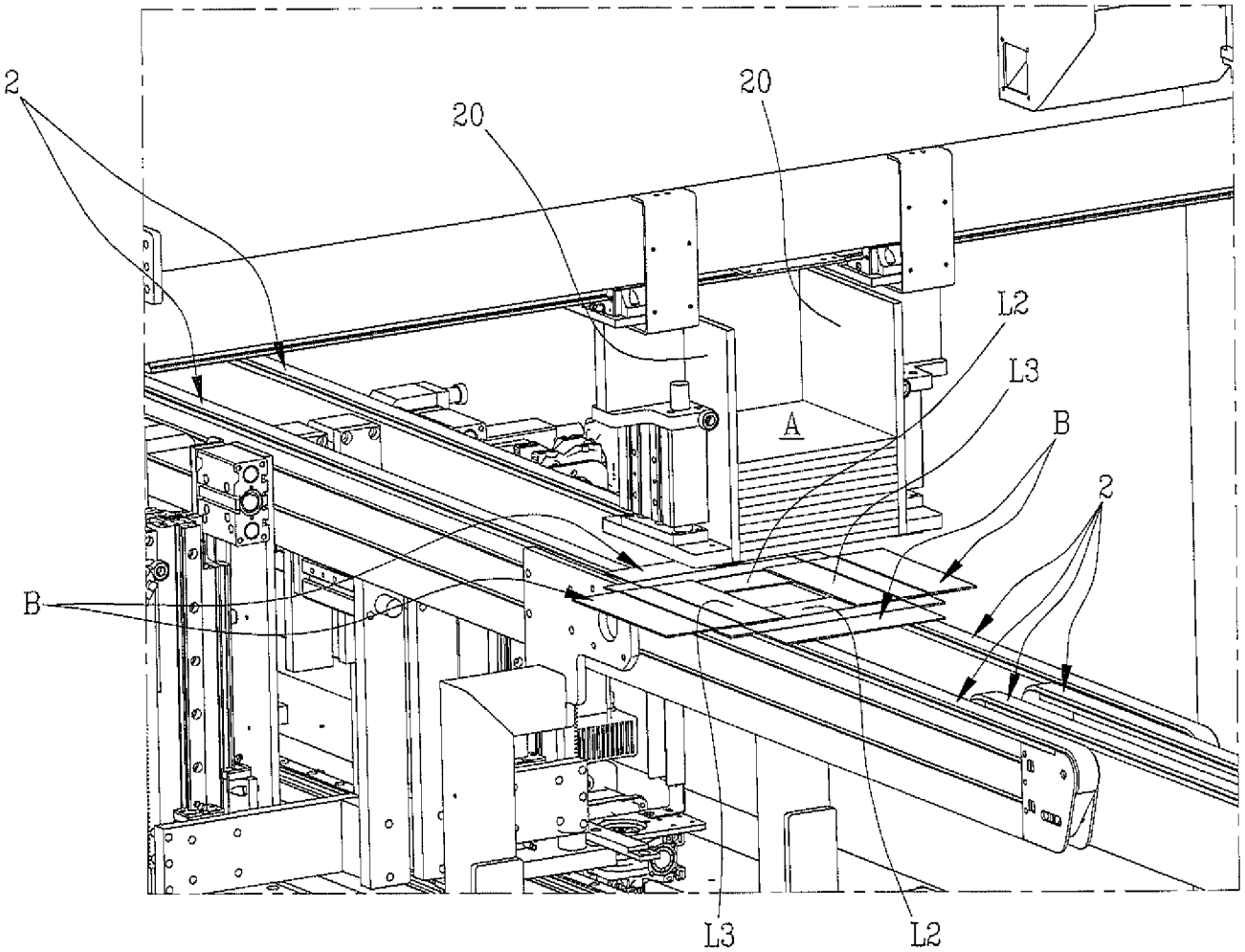
Figure 10:
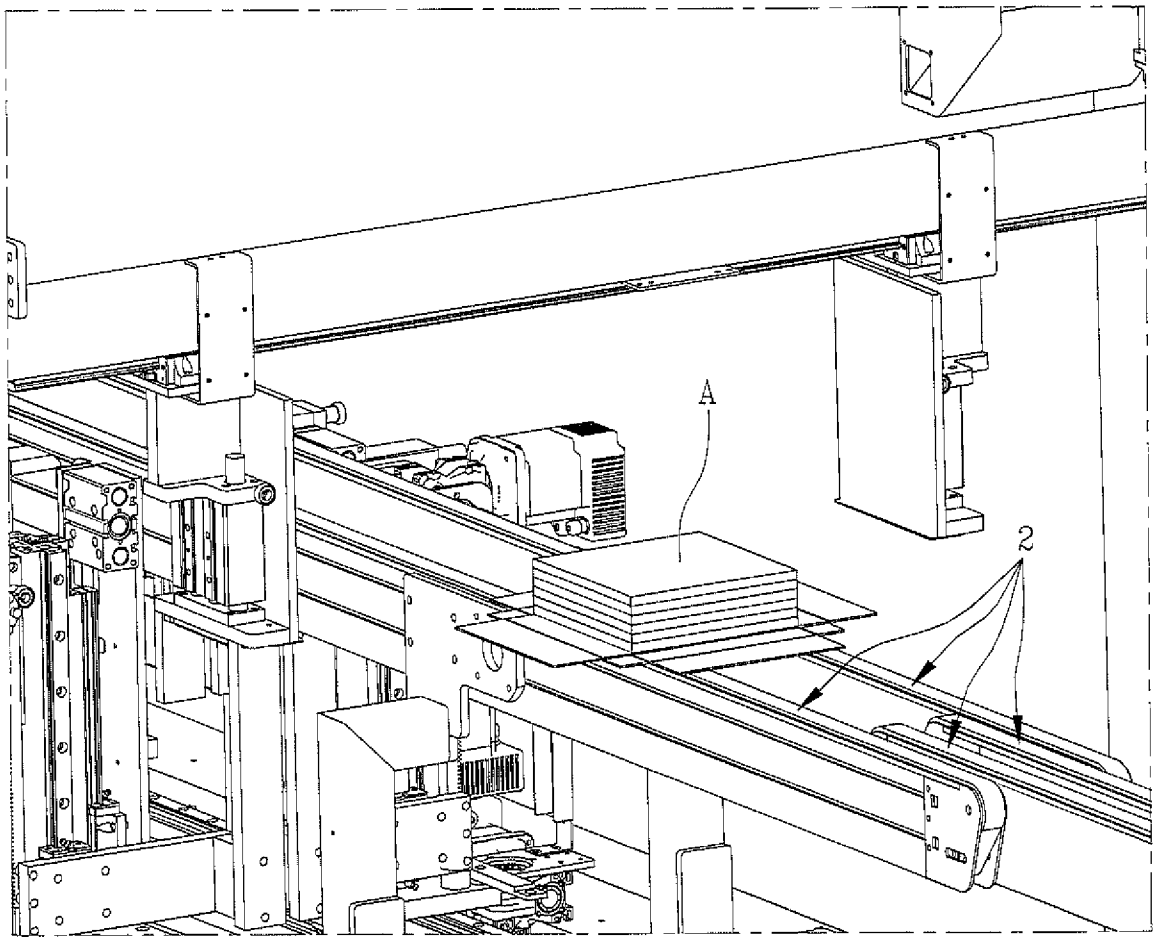

The article (A) to be packaged can be maintained raised from the rest surface (2) by means of the support (20) (FIG. 8). Thereafter the handlers enter into function by raising a blank from the relative store and depositing the blank on the rest surface (FIG. 9). The blanks (B), which are in a flat configuration, are arranged as shown in FIGS. 2 and 9, i.e. forming a rectangular or quadrangular frame. The action of the handlers can take place substantially contemporaneously, by providing a small-scale offset which enables depositing the blanks (B) so that they partly superpose in the end zones. For example, two opposite blanks can be deposited merely an instant before the other two opposite blanks, so that they partly superpose on the first two opposite blanks in the end zones, as shown in FIGS. 2 and 9. When the arrangement of the blanks (B) has been completed, the article to be packaged is deposited on the rest surface (2), partly superposing the blanks (FIG. 10). Thereafter the article and the blanks (B) are distanced by means of the rest surface (2).

In a particularly advantageous configuration, the blanks (B) are deposited according to an overall quadrangular border with the second side flaps (L3) facing inwards so that the article (A) can be superposed thereon, as shown in FIG. 10.

The operations described and the sequence in which they are carried out are controlled using a main control device, for example an electronic processor, programmable on the basis of the characteristics of the articles (A) to be packaged and of the packages to be realised. The management control carried out by the main control device can be aided by the use of sensors of various types, which for example detect the correct positioning of articles (A) and blanks (B), in a known way to the expert in the sector.

The machine further comprises one or more gluing devices (G), known to the technical expert in the sector, of which only one is schematically illustrated in FIG. 7. Each gluing device is structured in such a way that a quantity of adhesive can be arranged on the surface of at least two blanks (B) arranged opposite one another. In particular, the gluing device (G), for example in the form of a dispenser nozzle, is predisposed for depositing adhesive on the areas of the blanks (B) destined to be superposed on one another, so that the blanks (B) join to make up the packaging (C). The pressure exerted by the articles (A) facilitates the gluing of the blanks (B).

Figure 4:
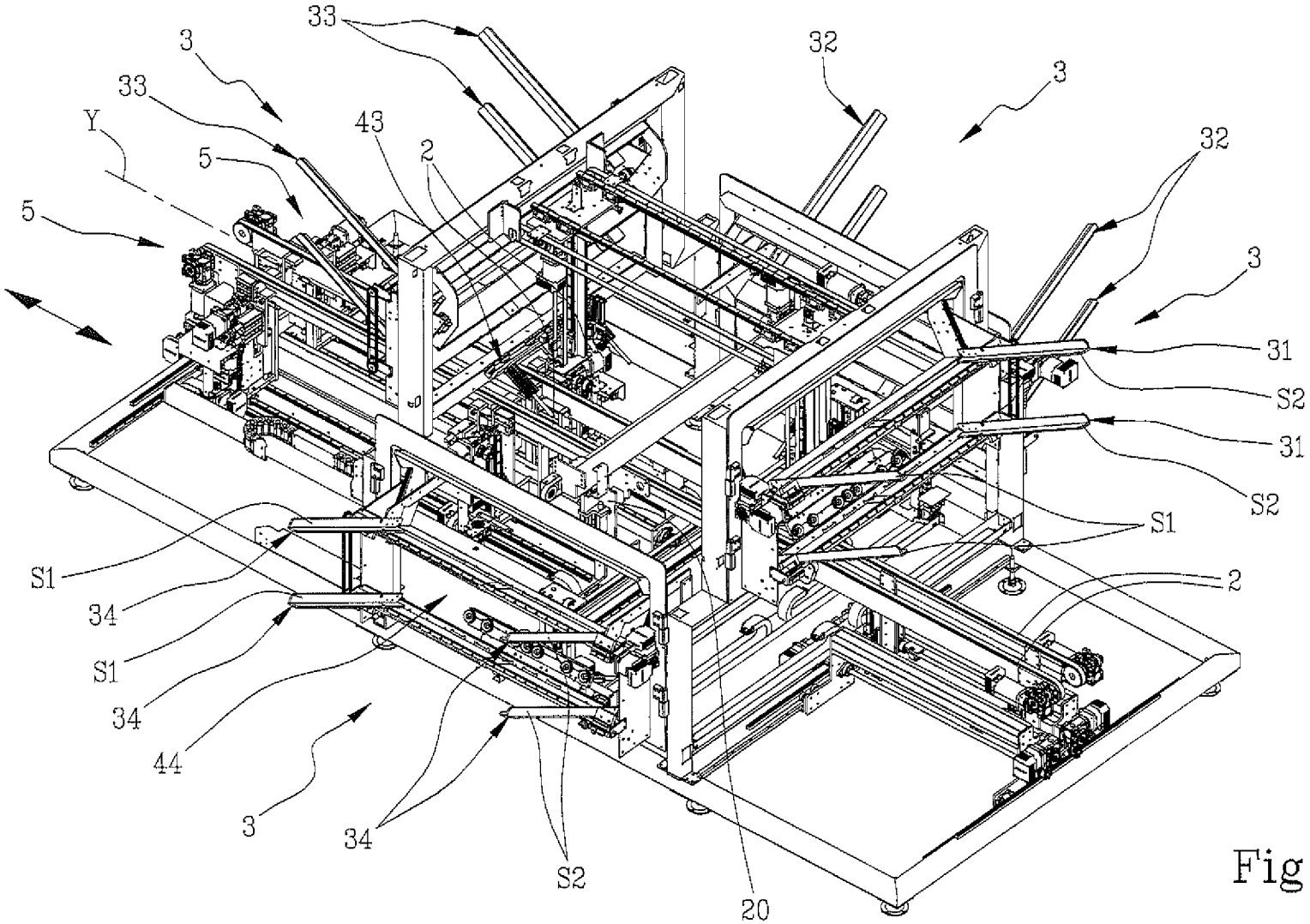
FIG. 4 shows a schematic axonometric view of the machine according to the present invention.
Figure 4A:
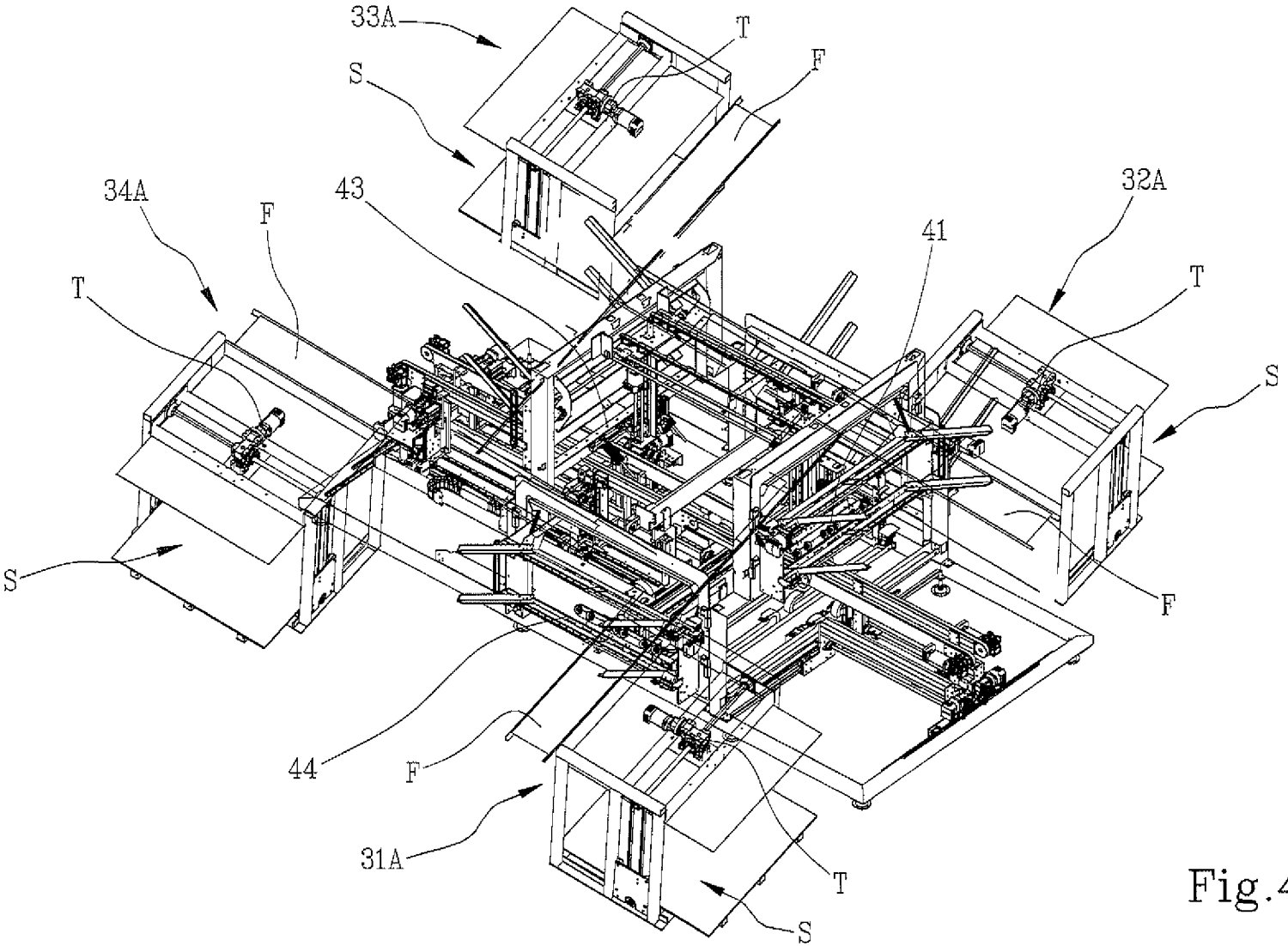
FIG. 4A shows a schematic axonometric view of a second embodiment of the machine according to the present invention.
Figure 5:
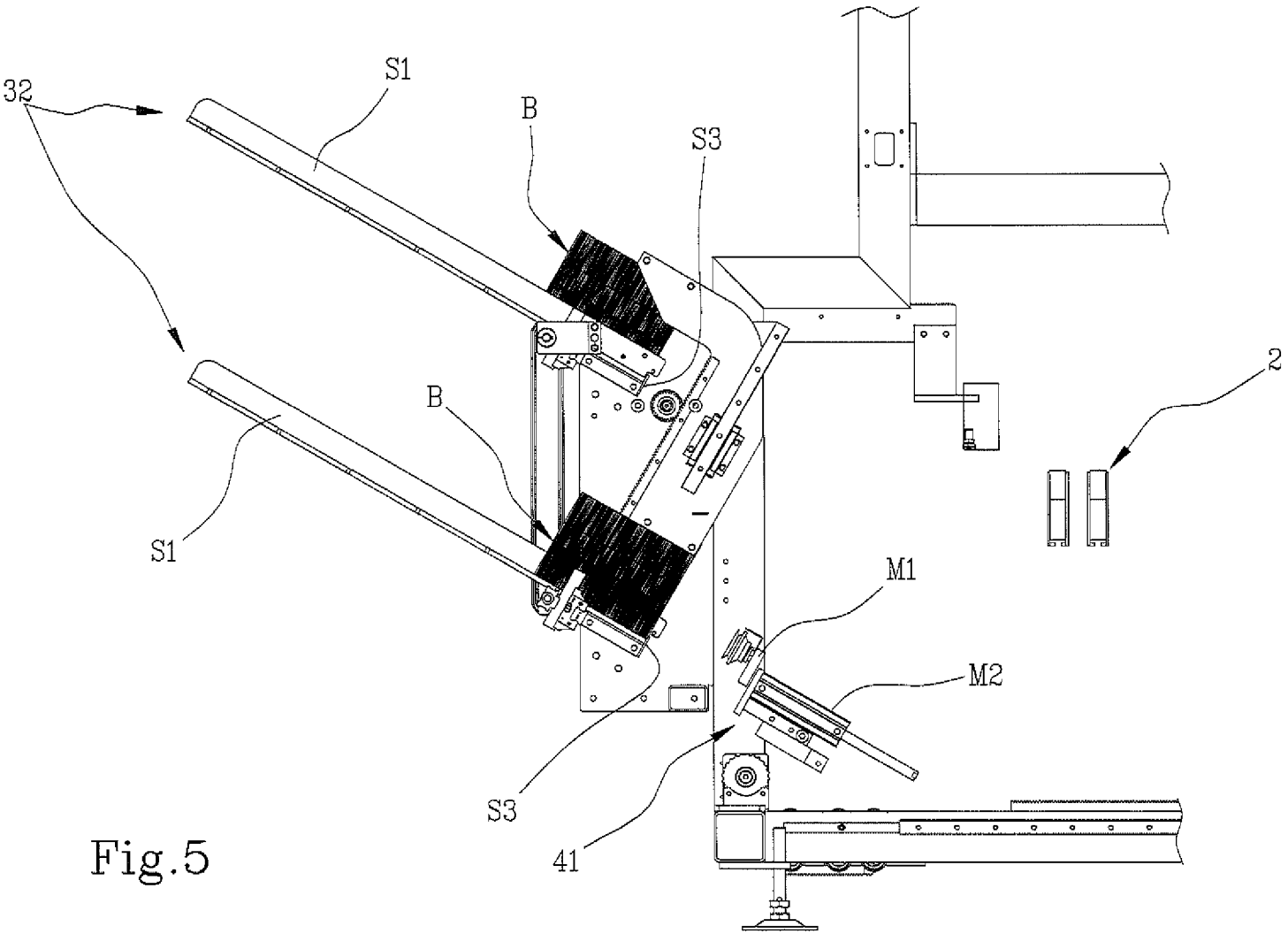
FIGS. 5, 6, 7 show three successive steps of an operating cycle carried out by a handler (41) of the machine; some parts of the machine have been removed so as to highlight the handler itself.

As illustrated in FIG. 4A, alternatively or in combination with the above-described stores, the machine might be provided with automatic stores (31A, 32A, 33A, 34A) of the type described in patent application WO2015/173744. Each of the automatic stores (31A, 32A, 33A, 34A) comprises a storage or deposit (S) for large-dimension blanks or for a continuous sheet. The automatic stores further comprise a cutting device (T), predisposed for collecting and sectioning the large-dimension sheets or the continuous sheet into blanks of requested shape and dimensions for the composition of the packaging (C). The main control system of the machine, or a control system dedicated to the purpose, commands the pick-up and cutting operations carried out by cutting means. The automatic stores can be located in proximity of the sides of the machine, for conveying the sectioned blanks (B) to sides of the article (A) to be packaged, i.e. at the border of the area on which the blanks (B) are deposited, in a flat configuration, on the rest surface (2). For example, the automatic stores can be arranged so as to position the blanks (B), previously cut by the cutting means, in zones that can be reached by the handlers (41,42, 43,44). For this purpose, each automatic store is provided with an infeed plane or device (F), in the form, for example, of a mobile plane, which feeds the previously-sectioned blanks (B) to the handlers (41,42,43,44). The infeed planes (F) are therefore arranged parallel and proximal to the sides of the article (A) to be packaged.

In the embodiment that combines the stores (31, 32, 33, 34) and the automatic stores (31A, 32A, 33A, 34A), the machine enables realising packages of various different shapes and dimensions. For example, some packages can be made with blanks (B) having a defined shape, colour or graphic design, housed in the stores (31, 32, 33, 34), while other packages can be made to precise measures starting from the blanks provided by the automatic stores (31A, 32A, 33A, 34A). It is also possible to realise packages that contemporaneously use the blanks (B) that are ready-made and blanks (B) that are shaped specifically by the automatic stores (31A, 32A, 33A, 34A). An in-line production might also alternate packages having different shapes, realised in succession starting from the different blanks (B) housed in the stores (31, 32, 33, 34) and/or specifically shaped by the automatic stores (31A, 32A, 33A, 34A).

Folder means (5) are predisposed for folding the blanks (B) in such a way as to form the packaging (C). In the illustrated embodiment, the folder means (5) are operative on the rest surface (2), which transfers the blanks (B) arranged in a framing fashion and the articles (A) to be packaged from the store zone of the blanks to the folder means. In the illustrated embodiment, the rest surface (2) comprises two consecutive sections, each of which comprises a pair of motorised belts that are parallel to one another. A different transport device might however be provided, not illustrated in detail as this is a device known to the technical expert in the sector. In a possible further embodiment of the machine, the folder means (5) might operate at the rest surface (2) and the depositing zone of the blanks (B), i.e. in the area comprised between the stores (31,32,33,34).

In the illustrated embodiment (figures from 11 to 14), the folder means (5) comprise, for each blank (B) of the packaging, a cursor (51), provided with a projecting operating end (52). The cursor (51) is mobile between an initial position, wherein the operating end (52) is located below the level of the rest surface (2) and spaced apart from the article (a) to be packaged, and a final position, wherein the operating end (52) is located above the article (A) to be packaged and flanked to the article (A) itself.

Figure 11:
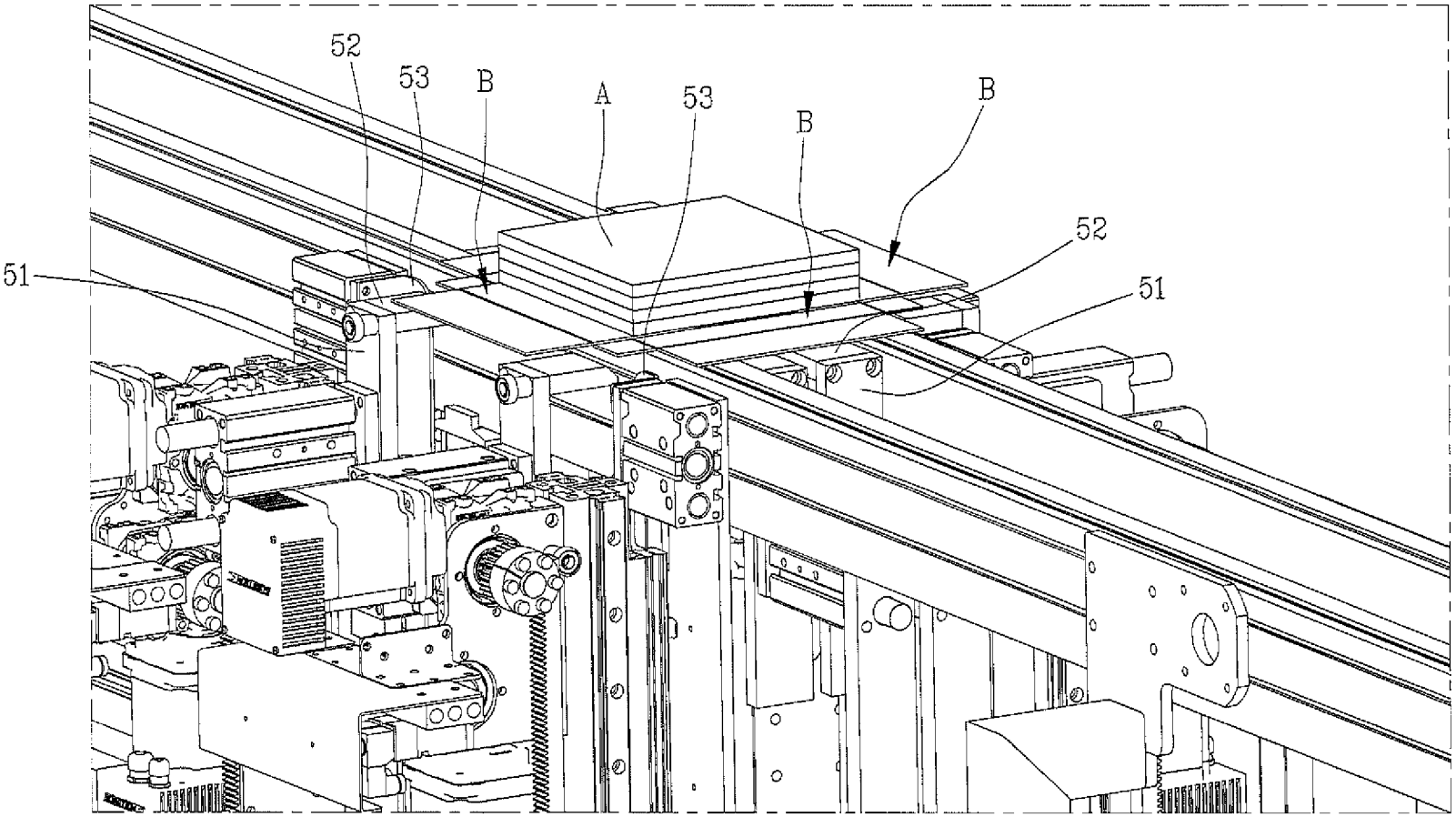
FIGS. 11, 12, 13, 14 show four successive steps of the folding of the blanks (B) about the articles (A) for realising a packaging (C) which at least partly envelops the articles (A).
Figure 12:
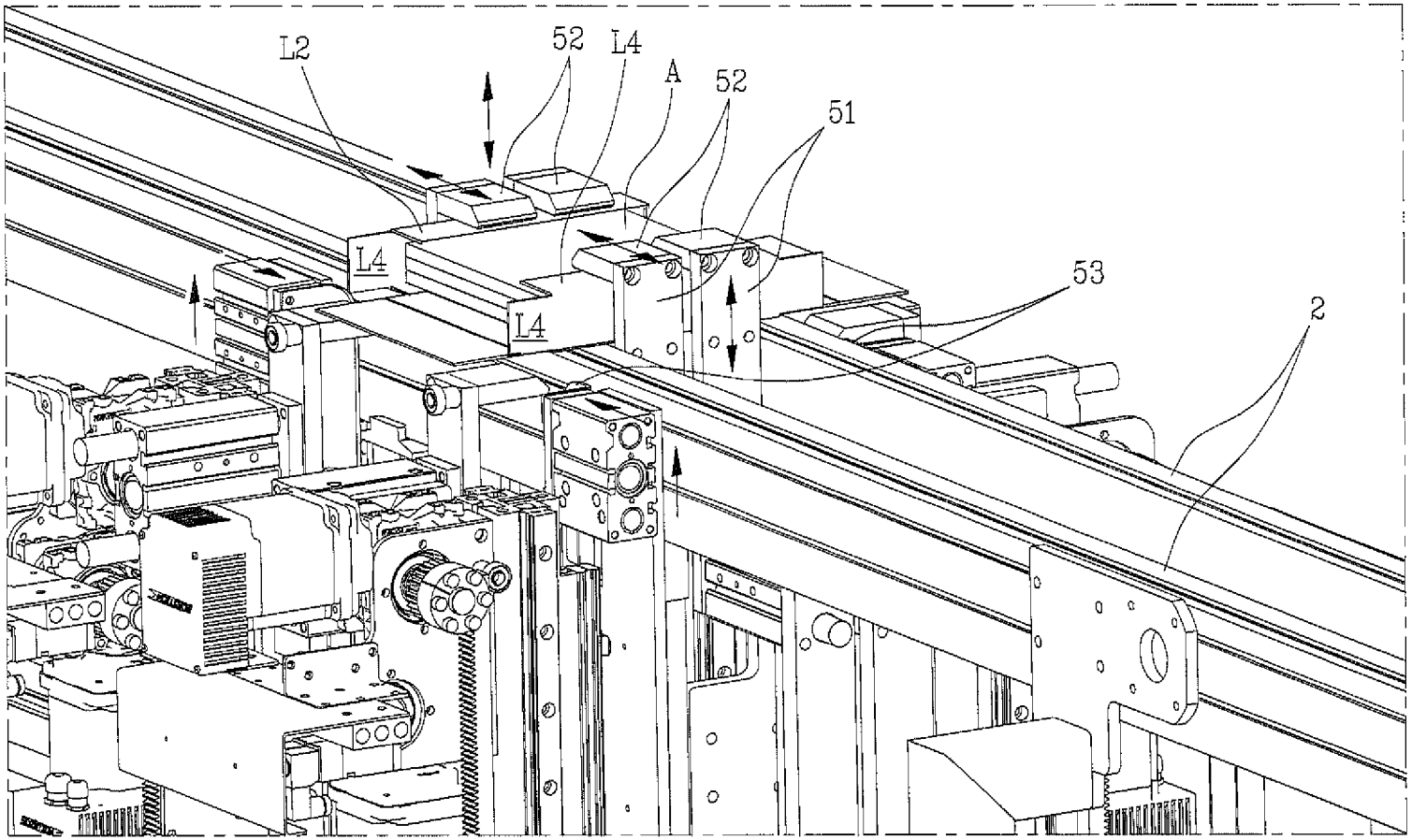

Each cursor (51) operates on one of the blanks (B) which shape the packaging (C). In the initial position (FIG. 11), the cursor (51) is located below the level of the rest surface (2), and therefore of the blank (B) to be folded. Note that, as already mentioned, the blanks (B) are in a substantially flat configuration and are arranged in a frame below the article (A), which rests on the blanks (B), maintaining them pressed onto the rest surface (2). Starting from the initial position the cursor (51) rises, entering into contact with the blank (B) with the operating end (52) (FIG. 12). During this travel upwards, the blank (B) is then folded to a right-angle about a first fold line which divides the second lateral flap (L3) of the blank (B), located below the article (A), from the median flap (L1) which is arranged by a flank of the article (A). When the travel reaches the topmost point, in which the operating end (52) is located above the article (A), the cursor (51) displaces in a nearing direction to the article (A). The operating end (52) superposes on the article (A), folding the blank (B) to a right-angle about a second fold line which separates the median flap (L1) from the first flap (L2) which, in turn, superposes on the article (A). The folding of the blanks (B) therefore takes place in an overall direction from the bottom upwards.

Figure 13:
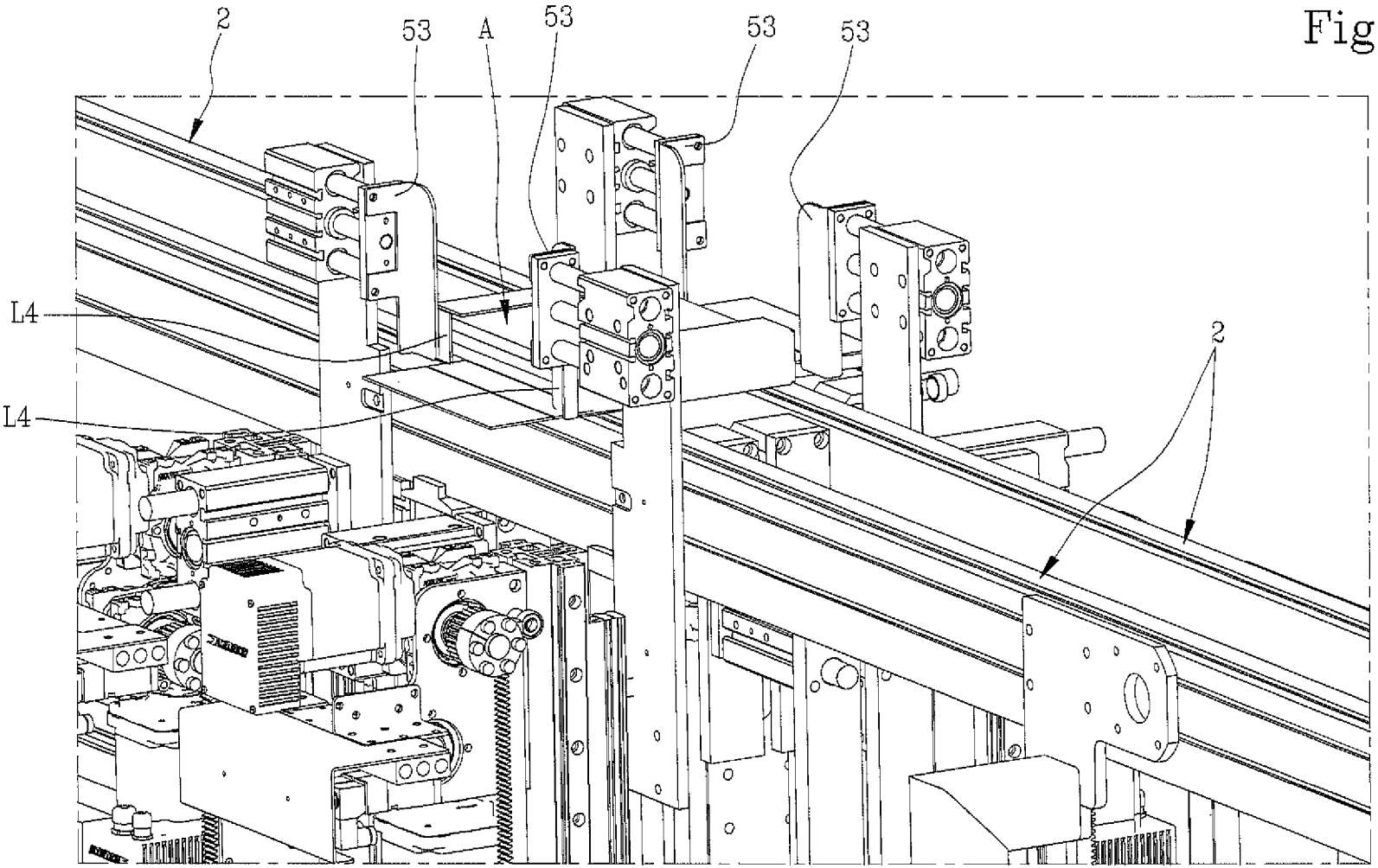
Figure 14:
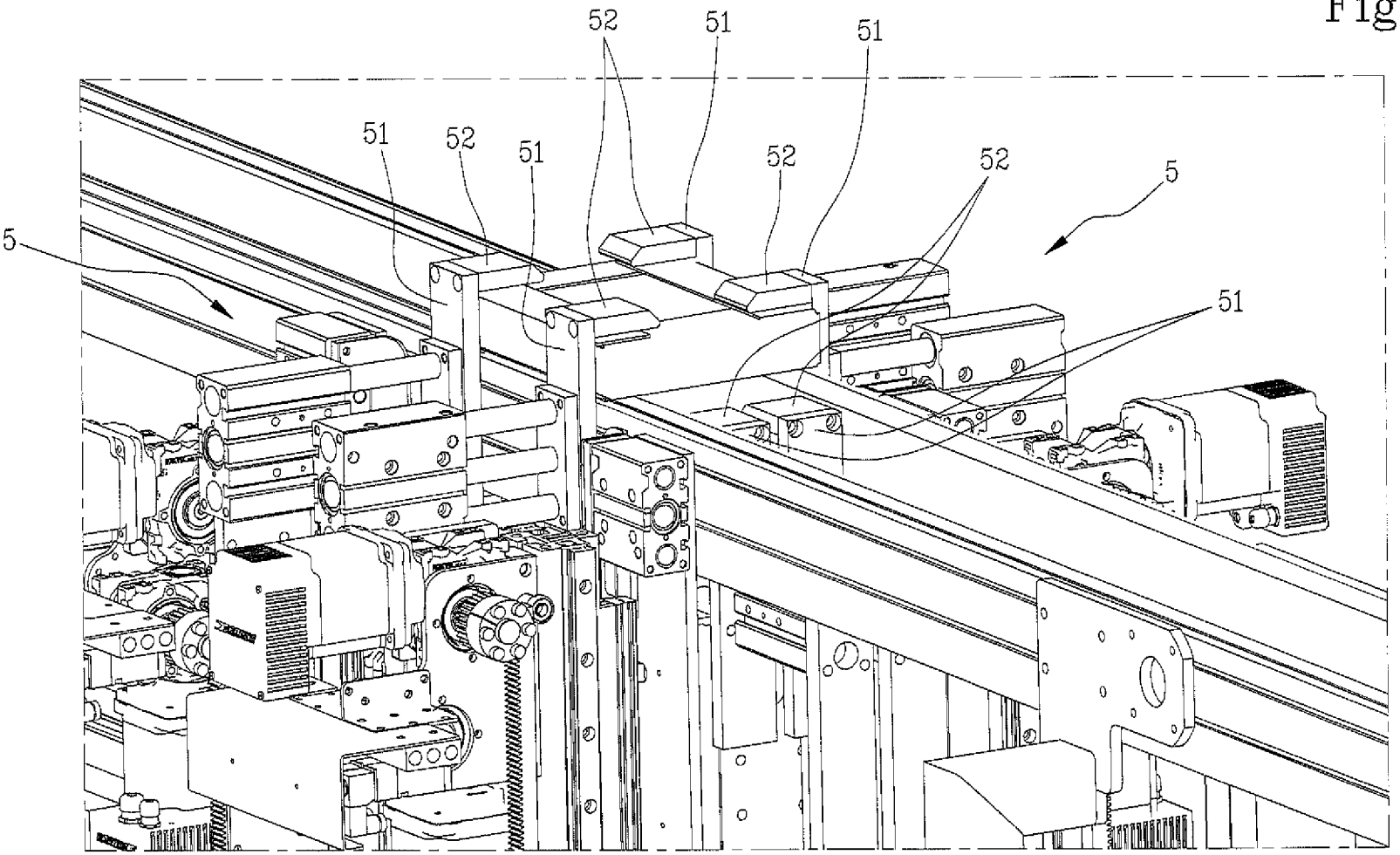

The movements of the various cursors (51) are synchronised in such a way as to enable the partial superposing of some end zones of the upper portions (L2) of the sides (L). For example, the cursors (51) operating on two opposite sides (FIGS. 12 and 13) can move in advance with respect to the cursors operating on the other two opposite sides (FIG. 14). In this way, the upper portions (L2) of the first two sides fold first and are then surmounted, in the end zones, by the upper portions (L2) of the other two sides.

The folder means (5) preferably comprise two cursors (51) for each side of the package (C). The cursors (51) operating on the same side are located in end zones of the side.

The folder means (5) can be provided with a pair of horizontal cursors (53) for at least a blank (B) of the packaging, which pair of horizontal cursors (53) is mobile along a horizontal direction between a retracted position (FIG. 12), in which they are distanced from the blank (B), and an advanced position (FIG. 13), in which they are in contact with an end of the blank (B) and fold said end about a vertical axis so as to arrange the end in contact with the article (A) to be packaged.

The horizontal cursors (53) are useful in a case in which at least a blank (B), or preferably two opposite blanks (B) in the packaging (C), have end flaps (L4) destined to fold and superpose on a lateral flank of the article (A). The end flaps significantly strengthen the corner zones of the package (C).

The horizontal cursors (53) are further vertically mobile between a lower position and an upper position. In the upper position the horizontal cursors are at a height that is substantially aligned to the height of the end flaps (L4) when they are arranged by a flank of the article (4). The horizontal cursors (53) can be autonomously mobile, or can be associated to two cursors (51) operating on the same side (L) of the packaging (C) in which a blank with end flaps (L4) is provided. In this case, the horizontal cursors (53) are brought towards the upper position thereof by the cursors (51) to which they are associated.

The folder means (5), i.e. the cursors (51) and the horizontal cursors (53), are mobile along the transport direction (Y) for a variable length of travel. In particular, the cursors (51) and the horizontal cursors (53) can translate along the transport direction (Y) so as to assume a position compatible with the length of the sides of the article (A) arranged parallel to the transport direction (Y). This enables adapting the position of the folder means to packages (C) of differing lengths, measured parallel to the transport direction (Y). Further, in the case of a length change of the articles on the line, at least two cursors (51) can displace along the transport direction (Y) in an opposite direction with respect to the article (A), in order to reduce the positioning times and, consequently, the packaging times of the article (A) itself.

The invention claimed is:

1. A packaging machine, comprising:

a rest surface (2) for supporting blanks (B) intended to form a quadrangular packaging (C);

a first store (31), a second store (32), a third store (33) and fourth store (34), each of said stores being structured for containing a plurality of blanks (B) intended to form the packaging (C);

a first handler (41) structured so as to pick up the blanks (B) from the first store (31) and to arrange the blanks (B) from the first store (31) on the rest surface (2);

a second handler (42) structured so as to pick up the blanks (B) from the second store (32) and to arrange the blanks (B) from the second store (32) on the rest surface (2);

a third handler (43) structured so as to pick up the blanks (B) from the third store (33) and to arrange the blanks (B) from the third store (33) on the rest surface (2); and a fourth handler (44) structured so as to pick up the blanks (B) from the fourth store (34) and to arrange the blanks (B) from the fourth store (34) on the rest surface (2); and folder means (5), structured so as to fold the blanks (B) arranged on the rest surface (2) in such a way as to form the packaging (C).

2. The packaging machine according to claim 1, wherein the four stores (31,32,33,34) are arranged along a rectangular perimeter.

3. The packaging machine according to claim 1, wherein each of said first, second, third and fourth stores (31,32,33,34) is structured so as to contain at least a blank (B) in a position parallel to a side of an article (A) to be packaged.

4. The packaging machine according to claim 1, wherein each of said first, second, third and fourth stores (31,32,33,34) comprises two lateral borders (S1, S2) which are structured so as to laterally contain a stack of blanks (B), and a support abutment (S3) for supporting the stack of blanks (B).

5. The packaging machine according to claim 1, wherein each of said first, second, third and fourth handlers (41,42,43,44) comprises a pick-up device (M1), which is structured so as to be associated with a blank (B); and a motor device (M2), structured for moving the pick-up device (M1) between a pick-up position, wherein the pick-up device (M1) can be associated with a blank (B) and a release position, in which the pick-up device (M1) can deposit the blank (B) on the rest surface (2).

6. The packaging machine according to claim 5, wherein the motor device (M2) is structured for rotating the pick-up device (M1) about a first horizontal axis and/or for translating the pick-up device (M1) along an axis which is perpendicular to the first horizontal axis.

7. The packaging machine according to claim 1, wherein the folder means (5) comprise a first cursor (51) for each blank (B) of the packaging, which first cursor (51) is provided with an operating end (52) that is projecting and mobile between an initial position, wherein the operating end (52) is located below the rest surface (2) and distanced from an article (A) to be packaged, and a final position, wherein the operating end (52) is located above the article (A) to be packaged and flanked to the article (A) itself.

8. The packaging machine according to claim 7, wherein the folder means (5) comprise a pair of second cursors (53) for at least a blank (B) of the packaging, which pair of second cursors (53) is mobile along a horizontal direction between a retracted position, in which the second cursors (53) are distanced from the blank (B), and an advanced position, in which the second cursors (53) are in contact with a respective end of the blank (B) and fold said end of the blank (B) about a vertical axis so as to arrange the end of the blank (B) in contact with the article (A) to be packaged.

9. The packaging machine according to claim 1, comprising a gluing device (G), which is structured in such a way that a quantity of adhesive can be arranged on a surface of each of two blanks (B) arranged opposite one another.

* * * * *